United States Patent [19]

Gunther et al.

[11] Patent Number: 4,581,330

[45] Date of Patent: Apr. 8, 1986

[54] TELLURIUM SALT FOG INHIBITING AGENTS FOR SILVER HALIDE PHOTOGRAPHY

[75] Inventors: Wolfgang H. H. Gunther, Webster; Roger Lok, Hilton, both of N.Y.

[73] Assignee: Eastman Kodak Company, Rochester, N.Y.

[21] Appl. No.: 702,545

[22] Filed: Feb. 19, 1985

[51] Int. Cl.[4] ..... G03C 1/34

[52] U.S. Cl. ..... 430/611; 430/614; 430/428; 430/446; 430/448

[58] Field of Search ..... 430/611, 614, 428, 446, 430/448

[56] References Cited

PUBLICATIONS

*Research Disclosure*, vol. 176, Item 17643, Dec. 1978.

T. H. James, *The Theory of the Photographic Process*, 4th Ed., Macmillan, 1977, pp. 393–399.

*Primary Examiner*—Won H. Louie

*Attorney, Agent, or Firm*—Carl O. Thomas

[57] ABSTRACT

Radiation sensitive silver halide photographic elements are disclosed which are protected from fog by aromatic oxatellurazinium salts. The aromatic oxatellurazinium salts can be initially incorporated in the photographic element as manufactured or during processing.

20 Claims, No Drawings

TELLURIUM SALT FOG INHIBITING AGENTS FOR SILVER HALIDE PHOTOGRAPHY

FIELD OF THE INVENTION

This invention relates to photography. It relates to silver halide photographic elements and to imaging processes.

BACKGROUND OF THE INVENTION

In the course of processing a photographic element containing an imagewise exposed silver halide emulsion layer reduced silver can be formed either as a direct or inverse function of exposure. At the same time, at least a low level of reduced silver formation also occurs independently of imagewise exposure. The term "fog" is herein employed to indicate the density of the processed photographic element attributable to the latter, usually measured in minimum density areas. In color photography fog is typically observed as image dye density rather than directly as silver density.

Over the years a variety of differing materials have been introduced into silver halide emulsions to inhibit the formation of fog. *Research Disclosure*, Vol. 176, December 1978, Item 17643, Section VI, lists the more commonly employed fog inhibiting agents. *Research Disclosure* is published by Kenneth Mason Publications Limited; Emsworth; Hampshire P010 7DD; England. From Section VI it is apparent that useful fog inhibiting agents are highly diverse in their structural forms, ranging from halide ions (e.g. bromide salts) to inorganic metal salts to specific polymers to selected acyclic organic compounds to specific heterocycles. These useful fog inhibiting agents have been selected from among a plethora of structurally similar, but relatively ineffective compounds. Useful fog inhibiting agents have been largely identified empirically. T. H. James, *The Theory of the Photographic Process*, 4th Ed., Macmillan, 1977, pp. 393–399, in grouping and suggesting various performance mechanisms for fog inhibiting agents illustrates their diversity.

Gunther et al U.S. Ser. No. 660,155, filed Oct. 12, 1984, titled PHOTOGRAPHICALLY USEFUL CHALCOGENAZOLES, CHALCOGENAZOLINES, AND CHALCOGENAZOLINIUM AND CHALCOGENAZOLIUM SALTS, commonly assigned, discloses to be useful as intermediates in synthesizing the title heterocycles compounds containing a 1,2,5-oxatellurazinium ring fused with an aromatic ring. A synthetic procedure for preparing these novel intermediates is also disclosed.

SUMMARY OF THE INVENTION

In one aspect this invention is directed to a photographic element containing a radiation sensitive silver halide emulsion and an effective amount of a fog inhibiting agent characterized in that the fog inhibiting agent is an aromatic oxatellurazinium salt.

In another aspect this invention is directed to a process of producing a photographic image comprising processing a photographic element containing at least one imagewise exposed silver halide emulsion in the presence of an effective amount of a fog inhibiting agent characterized in that the fog inhibiting agent is an aromatic oxatellurazinium salt.

The present invention permits the use of photographic elements containing radiation sensitive silver halide emulsions to produce photographic images exhibiting low levels of fog. The invention affords an alternative approach to fog reduction and in many instances fog reduction compares favorably with fog reduction achieved by other commonly employed and highly effective fog inhibiting agents.

DESCRIPTION OF PREFERRED EMBODIMENTS

The present invention is based on the discovery that oxatellurazinium salts are effective in inhibiting fog. This invention has been necessarily predicated upon obtaining for investigation oxatellurazinium salts, a class of compounds not known to the art prior to this invention. Initial investigations have been conducted with oxatellurazinium salts containing a 1,2,5-oxatellurazinium ring fused with an aromatic ring. Although it is a synthetic convenience to have a fused aromatic ring present, fog inhibiting activity is attributed to the oxatellurazinium ring, which forms an inner salt. Substituents can take any form compatible with the oxatellurazinium ring structure.

Initial investigations have been conducted employing oxatellurazinium salts satisfying formula

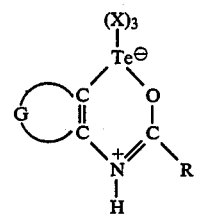

(I)

prepared by reacting a compound according to formula

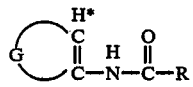

(II)

with $TeX_4$ at an elevated temperature, wherein:

H* is an activated hydrogen atom,

G represents the atoms completing an aromatic nucleus,

R represents an aliphatic or aromatic group comprised of a hydrocarbon moiety optionally linked through a divalent oxy, thio, or carbonyl linkage, an amino group, an amido group, a ureido group, a formamidine disulfide group, or a —C(O)M group, wherein M is chosen to complete an acid, ester, thioester, or salt, and X represents halogen or pseudohalogen.

X in formula (I) is determined by the choice of the $TeX_4$ compound employed in synthesis or in a post-sythesis conversion step. X can be halogen (employed here and elsewhere to designate generically chloride, bromide, or iodide) or a pseudohalogen (i.e., one of the recognized class of substituents known to approximate the substituent properties of halogen), such as a cyano, thiocyanate, or hydroxy substituent. In a specifically preferred form X is chloride or bromide.

When the compound of formula (II) is melted or heated in a suitable solvent (e.g., acetonitrile, butyronitrile, or chloroform) with tellurium tetrabromide or, preferably, tellurium tetrachloride, the material of formula (I) in which X is chloride or bromide is produced.

Heating to a temperature of at least 60° C. up to about 140° C. is contemplated, with temperatures of from about 110° to 120° C. being preferred. If desired, the chloride or bromide in the formula (I) compound can be displaced by iodide or a psuedohalogen by treatment with an iodide or pseudohalogen salt, thereby permitting the full range of values of X in formula (I) to be realized. In part the reaction to produce the material of formula (I) is accomplished by choosing G in formula (II) so that the aromatic nucleus which it completes is activated in the position ortho to the amido substituent. This can be accomplished by including in the aromatic nucleus one or more substituents capable of directing ring substitution in formula (II) to the ring position of the starred activated hydrogen atom. For carbocyclic aromatic rings, such as benzene and naphthene rings, useful substituents can be chosen from among aliphatic and aromatic groups comprised of hydro carbon moieties (e.g., alkyl, aryl, alkaryl, or alkaryl) optionally linked through a divalent oxygen or sulfur atom (e.g., an alkoxy, aryloxy, alkaryloxy, alkaryloxy, alkylthio, arylthio, alkarylthio, or alkarylthio group); an amino group, including primary, secondary and tertiary amines; an amido group (e.g., acetamido and butyramido); a sulfonamido group (e.g. an alkyl or arylsulfonamido group); a sulfamoyl group (e.g. an alkyl or arylsulfamoyl group); a ureido group (e.g., 1-ureido, 3-phenyl-1-ureido, and 3-methyl-1-ureido); hydroxy; or a —C(O)M group or —$S(O)_2M$ group, wherein M is chosen to complete an acid, ester, thioester, or salt (e.g., —C(O)OH, —$C(O)SCH_3$, —$C(O)OCH_3$, —C(O)ONa, —$S(O)_2OH$, —$S(O)_2OCH_2C_6H_5$, or —$S(O)_2OLi$).

The substituent R can take any synthetically convenient form. R can include an aliphatic or aromatic group comprised of a hydrocarbon moiety (e.g., alkyl, aryl, alkaryl, or aralkyl moiety) optionally linked through a divalent oxy, thio, or carbonyl linkage (e.g., an alkoxy, aryloxy, alkaryloxy, aralkyloxy, alkylthio, arylthio, alkarylthio, aralkylthio, or acyl moiety); an amino group, including primary, secondary and tertiary amines; an amido group (e.g., acetamido and butryamido); a ureido group (e.g., 1-ureido, 3-phenyl-1-ureido, and 3-methyl-1-ureido); a formamidine disulfide group (e.g., formamidine disulfide and N'-ethyl-N'-methyl-$\alpha,\alpha'$-dithiobisformamidine groups); or a —C(O)M group, wherein M is chosen to complete an acid, ester, thioester, or salt (e.g., —C(O)OH, —$C(O)OCH_3$, —$C(O)SCH_3$, or —C(O)ONa). When R is a primary amino group, it is in fact in one tautomeric form an imino group, which provides a convenient reaction site for further substitution.

While the oxatellurazinium salts of formula (I) have been conveniently accessible for initial investigations based on the method for their preparation disclosed above, the synthetic method for preparing oxatellurazinium salts is not a part of the present invention. Thus, the present invention is considered to extend to oxatellurazinium salts generally without regard to the method by which they are prepared.

The oxatellurazinium salt fog inhibiting agents are preferably incorporated in the photographic element to be protected prior to exposure and processing—e.g., at the time of manufacture. When the oxatellurazinium salt is being relied upon to reduce fog the origin of which antedates processing, it is essential that the oxatellurazinium salt be incorporated in the silver halide emulsion layer or layers to be protected. It is generally most convenient to introduce the oxatellurazinium salt into the silver halide emulsion after chemical ripening of the emulsion and before coating.

When the oxatellurazinium salt is intended to become active at the time of processing, it can be incorporated within the photographic element at any location which permits permeation of one or more silver halide emulsion layers being imagewise developed. For example, the oxatellurazinium salt can be located in one or more silver halide emulsion layers or other hydrophilic colloid layers, such as in an overcoat, interlayer, or subbing layer. When the oxatellurazinium salt is intended to become active at the time of processing, it is generally most convenient to add the oxatellurazinium salt as a component of a processing solution, such as predevelopment bath or a developer, allowing it to permeate the silver halide emulsion layer or layers prior to or during development.

Any amount of oxatellurazinium salt effective to reduce fog can be employed. Optimum amounts of fog inhibiting agents for specific applications are usually determined empirically by varying concentrations. Such investigations are typically relied upon to identify optimum fog reduction concentrations or an optimum balance between fog reduction and other effects, such as reduction in photographic speed. Based on the investigations reported below, when the oxatellurazinium salt is incorporated in a silver halide emulsion prior to coating, concentrations of from about 5.0 to 0.005 millimole per silver mole preferably 0.5 to 0.01 millimole per silver mole, and optimally from 0.15 to 0.015 millimole per silver mole are contemplated. When the oxatellurazinium salt is incorporated in a processing solution, concentration ranges from minimum effective amounts—e.g., typically at least 0.05 millimole per liter—to up to about 0.5 millimole per liter are contemplated.

It is, of course, recognized that conventional fog inhibiting agents, such as those illustrated by *Research Disclosure*, Item 17643, Section VI, cited above, can be employed in combination with oxatellurazinium salts in the practice of this invention. Since it is recognized that fog inhibiting agents operate by a variety of differing mechanisms, as illustrated by James, cited above, the effects produced by combinations of oxatellurazinium salts and conventional fog inhibiting agents will range from highly interdependent to independently additive, but in any case optimum concentrations are susceptible to empirical determination.

In addition to the fog inhibiting agent this invention additionally requires a photographic element containing a radiation sensitive silver halide emulsion. These silver halide emulsions can be comprised of silver bromide, silver chloride, silver iodide, silver chlorobromide, silver chloroiodide, silver bromoiodide, silver chlorobromoiodide or mixtures thereof. The emulsions can include silver halide grains of any conventional shape or size. Specifically, the emulsions can include coarse, medium or fine silver halide grains of either regular (e.g., cubic or octahedral) or irregular (e.g., multiply twinned or tabular) crystallographic form. Recently developed high aspect ratio tabular grain emulsions, such as those disclosed by Wilgus et al U.S. Pat. No. 4,434,226, Daubendiek et al U.S. Pat. No. 4,414,310, Wey U.S. Pat. No. 4,399,215, Solberg et al U.S. Pat. No. 4,433,048, Mignot U.S. Pat. No. 4,386,156, Evans et al U.S. Ser. No. 553,911, filed Nov. 21, 1983, commonly assigned, Maskasky U.S. Pat. No. 4,400,463, Wey et al U.S. Pat. No. 4,414,306, and Maskasky U.S. Pat. No. 4,435,501, are specifically contemplated. Sensitizing compounds, such as compounds of copper, thallium, lead, bismuth, cadmium and Group VIII noble metals, can be present during precipitation of the silver halide emulsion, as illustrated by Arnold et al U.S. Pat. No. 1,195,432, Hochstetter U.S. Pat. No. 1,951,933, Trivelli et al U.S. Pat. No. 2,448,060, Overman U.S. Pat. No. 2,628,167, Mueller et al U.S. Pat. No. 2,950,972, Sidebotham U.S. Pat. No. 3,488,709 and Rosecrants et al U.S. Pat. No. 3,737,313.

The silver halide emulsions can be either monodispersed or polydispersed as precipitated. The grain size distribution of the emulsions can be controlled by silver halide grain separation techniques or by blending silver halide emulsions of differing grain sizes. The emulsions can include Lippmann emulsions and ammoniacal emulsions, as illustrated by Glafkides, *Photographic Chemistry*, Vol. 1, Fountain Press, London, 1958, pp. 365–368 and pp. 301–304; excess halide ion ripened emulsions as described by G. F. Duffin, *Photographic Emulsion Chemistry*, Focal Press Ltd., London, 1966, pp. 60–72; thiocyanate ripened emulsions, as illustrated by Illingsworth U.S. Pat. No. 3,320,069; thioether ripened emulsions, as illustrated by McBride U.S. Pat. No. 3,271,157, Jones U.S. Pat. No. 3,574,628 and Rosecrants et al U.S. Pat. No. 3,737,313 or emulsions containing weak silver halide solvents, such as ammonium salts, as illustrated by Perignon U.S. Pat. No. 3,784,381 and *Research Disclosure*, Vol. 134, June 1975, Item 13452.

The emulsions can be surface-sensitive emulsions—i.e., emulsions that form latent images primarily on the surfaces of the silver halide grains—or internal latent image-forming emulsions—i.e., emulsions that form latent images predominantly in the interior of the silver halide grains, as illustrated by Knott et al U.S. Pat. No. 2,456,953, Davey et al U.S. Pat. No. 2,592,250, Porter et al U.S. Pat. Nos. 3,206,313 and 3,317,322, Bacon et al U.S. Pat. No. 3,447,927, Evans U.S. Pat. No. 3,761,276, Morgan U.S. Pat. No. 3,917,485, Gilman et al U.S. Pat. No. 3,979,213 and Miller U.S. Pat. No. 3,767,413.

The emulsions can be negative working emulsions, such as surface-sensitive emulsions or unfogged internal latent image-forming emulsions, or direct-positive emulsions of the unfogged, internal latent image-forming type, which are positive working when development is conducted with uniform light exposure or in the presence of a nucleating agent, as illustrated by Ives U.S. Pat. No. 2,563,785, Evans U.S. Pat. No. 3,761,276, Knott et al U.S. Pat. No. 2,456,953 and Jouy U.S. Pat. No. 3,511,662.

Blends of surface sensitive emulsions and internally fogged, internal latent image-forming emulsions can be employed, as illustrated by Luckey et al U.S. Pat. Nos. 2,996,382, 3,397,987 and 3,705,858, Luckey U.S. Pat. No. 3,695,881, *Research Disclosure*, Vol. 134, June 1975, Item 13452, Millikan et al Defensive Publication T-904017, Apr. 21, 1972 and Kurz *Research Disclosure*, Vol. 122, June 1974, Item 12233.

The oxatellurazinium salts are preferably employed to reduce fog in negative working silver halide emulsions and most preferably those that contain silver halide grains which form surface latent images on exposure.

The silver halide emulsions can be surface sensitized. Noble metal (e.g., gold), middle chalcogen (e.g., sulfur, selenium, or tellurium), and reduction sensitizers, employed individually or in combination are specifically contemplated. Typical chemical sensitizers are listed in *Research Disclosure*, Item 17643, cited above, Section III.

The silver halide emulsions can be spectrally sensitized with dyes from a variety of classes, including the polymethine dye class, which includes the cyanines, merocyanines, complex cyanines and merocyanines (i.e., tri-, tetra-, and polynuclear cyanines and merocyanines), oxonols, hemioxonols, styryls, merostyryls, and streptocyanines. Illustrative spectral sensitizing dyes are disclosed in *Research Disclosure*, Item 17643, cited above, Section IV.

The silver halide emulsions as well as other layers of the photographic elements of this invention can contain as vehicles hydrophilic colloids, employed alone or in combination with other polymeric materials (e.g., latices). Suitable hydrophilic materials include both naturally occurring substances such as proteins, protein derivatives, cellulose derivatives—e.g., cellulose esters, gelatin—e.g., alkali treated gelatin (cattle, bone, or hide gelatin) or acid treated gelation (pigskin gelatin), gelatin derivatives—e.g., acetylated gelatin, phthalated gelatin, and the like, polysaccharides such as dextran, gum arabic, zein, caein, pectin, collagien derivatives, collodion, agar-agar, arrowroot, and albumin. The vehicles can be hardened by conventional procedures. Further details of the vehicles and hardeners are provided in *Research Disclosure*, Item 17643, cited above, Sections IX and X.

The silver halide photographic elements of this invention can contain other addenda conventional in the photographic art. Useful addenda are described, for example, in *Research Disclosure*, Item 17643, cited above. Other conventional useful addenda include desensitizers, couplers (such as dye forming couplers, masking couplers and DIR couplers) DIR compounds, anti-stain agents, image dye stabilizers, absorbing materials such as filter dyes and UV absorbers, light scattering materials, antistatic agents, coating aids, plasticizers and lubricants, and the like.

The photographic elements of the present invention can be simple black-and-white or monochrome elements comprising a support bearing a layer of the silver halide emulsion, or they can be multilayer and/or multicolor elements. The photographic elements produce images ranging from low contrast to very high contrast, such as those employed for producing half tone images in graphic arts. They can be designed for processing with separate solutions or for in-camera processing. In the latter instance the photographic elements can include conventional image transfer features, such as those illustrated by *Research Disclosure*, Item 17643, cited above, Section XXIII. Multicolor elements contain dye image forming units sensitive to each of the three primary regions of the spectrum. Each unit can be comprised of a single emulsion layer or of multiple emulsion layers sensitive to a given region of the spectrum. The layers of the element, including the layers of the image forming units, can be arranged in various orders as known in the art. In an alternative format, the emulsion or emulsions can be disposed as one or more segmented layers, e.g., as by the use of microvessels or microcells, as described in Whitmore U.S. Pat. No. 4,387,154.

A preferred color photographic element according to this invention comprises a support bearing at least one blue sensitive silver halide emulsion layer having associated therewith a yellow dye forming coupler, at least one green sensitive silver halide emulsion layer having associated therewith a magenta dye forming coupler and at least one red sensitive silver halide emulsion layer having associated therewith a cyan dye forming coupler, at least one of the silver halide emulsion layers containing an oxatellurazinium salt fog inhibiting compound.

The elements of the present invention can contain additional layers conventional in photographic elements, such as overcoat layers, spacer layers, filter layers, antihalation layers, scavenger layers and the like. The support can be any suitable support used with photographic elements. Typical supports include polymeric films, paper (including polymer-coated paper), glass and the like. Details regarding supports and other layers of the photographic elements of this invention are contained in *Research Disclosure*, Item 17643, cited above, Section XVII.

The photographic elements can be imagewise exposed with various forms of energy, which encompass the ultraviolet, visible, and infrared regions of the electromagnetic spectrum as well as electron beam and beta radiation, gamma ray, X ray, alpha particle, neutron radiation, and other forms of corpuscular and wave-like radiant energy in either noncoherent (random phase) forms or coherent (in phase) forms, as produced by lasers. When the photographic elements are intended to be exposed by X rays, they can include features found in conventional radiographic elements, such as those illustrated by *Research Disclosure*, Vol. 184, August 1979, Item 18431.

Processing of the imagewise exposed photographic elements in the presence of the oxatellurazinium salt need not differ from conventional processing. Processing procedures, developing agents, and development modifiers are illustrated by *Research Disclosure*, Item 17643, cited above, Sections XIX, XX, and XXI, respectively. In its preferred application the invention relates to silver halide photographic elements which are processed in aqueous alkaline developers in the presence of the oxatellurazinium salt.

The following examples further illustrate the invention:

PREPARATIONS OF OXATELLURAZINIUM SALTS

The preparation of representative oxatellurazinium salts is illustrated by the preparation of five 1,1,1-trihalo (substituted) 2,1,4-benzoxatellurazinium, inner salts.

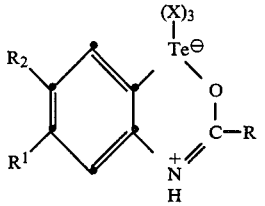

Te 1 — 1,1,1-Trichloro-6-methoxy-3-methyl-2,1,4-benzoxatellurazinium, inner salt
$R^1 = OCH_3$, $R^2 = H$, $R = CH_3$, $X = Cl$ $C_9H_{10}Cl_3NO_2Te$ — mw = 398.05

3-Methoxyacetanilide, (34 g=0.2 mole) and tellurium tetrachloride (54 g=0.2 mole) were jointly stirred into chloroform (100 ml) in a 500 ml Erlenmeyer flask. After an initial solution had been formed, the mass set solid with a fine yellow precipitate. The mixture was immersed in an oil bath kept at 115° C. The mixture was manually stirred until all solids had redissolved or melted. After most of the chloroform had evaporated, there resulted a clear yellow melt that rapidly became opaque while gaseous HCl was being emitted. The temperature was raised to 120° C. and heating continued with occasional manual stirring until the entire mass had set to a brittle solid. The reaction was terminated after 2 hours. Ethanol was added to the still hot reaction mixture to disperse the product. Recrystallization from ethanol (1300 ml) yielded colorless needles (47.1 g, 59% of theory), m.p. 245°-246° C.

C, Cl, H, N and Te elemental analyses were in agreement with those calculated for the structural formula.

Te 2 — 1,1,1-Trichloro-3,6-dimethyl-2,1,4-benzoxatellurazinium, inner salt
$R = R^1 = CH_3$, $R^2 = H$, $X = Cl$ $C_9H_{10}Cl_3NOTe$ — mw = 382.05

3-Methylacetanilide (m-acetotoluidide) (82 g=0.55 mole) and tellurium tetrachloride (148 g, 0.55 mole) were combined with chloroform (300 ml) and the mixture heated for 20 hours in an oil bath kept at 115° C. with continuous removal of HCl. The hot reaction product was dispersed in ethanol (200 ml) and the product collected by filtration to give a yield of 149 g, 71% of theory, colorless prisms, m.p. >300° C. For analyses the compound was recrystallized from boiling acetonitrile.

The elemental analyses were in agreement with those expected for the structural formula:

Te 3 — 1,1,1-Trichloro-3,6,7-trimethyl-2-1,4-benzoxatellurazinium, inner salt
$R = R^1 = R^2 = CH_3$, $X = Cl$ $C_{10}H_{12}Cl_3NOTe$ — mw = 396.07

3,4-Dimethylacetanilide (56 g=0.37 mole) was combined with $TeCl_4$ (100 g, 0.37 mole) in acetonitrile (100 ml) and immersed in an oil bath, first for one hour at 120° C. and then for 3 more hours at 130° C. Additional acetonitrile was added, and the partial solution was chilled. The product was collected by filtration to give 74.7 g, 52% of theory, colorless crystals, m.p. >300° C. after darkening at >280° C. Recrystallization from acetonitrile required 400 ml solvent for 15 g of the substance. C, H, Cl, N and Te elemental analyses were in agreement with those expected for the structural formula:

Te 4 — 1,1,1-Trichloro-3-methyl-6-methylthio-2,1,4-benzoxatellurazinium, inner salt
$R = CH_3$, $R^1 = SCH_3$, $R^2 = H$, $X = Cl$ $C_9H_{10}Cl_3NOSTe$ — mw = 413.95

3-Methylthioacetanilide (68 g=0.37 mole), prepared by acetylation of commercial 3-methylthioaniline, was combined with $TeCl_4$ (100 g=0.37 mole) in chloroform (100 ml). The mixture was heated for 3 hours in an oil bath kept at 130° C., then introduced hot into acetonitrile (300 ml), chilled, and filtered. A crystalline solid yielding 68 g, 49% of theory was obtained. For analysis the material was recrystallized from boiling acetonitrile (100 ml dissolves ≃4 g) with the aid of decolorizing charcoal and was recovered as lustrous, pale yellow prisms, m.p. 251°-253° C. The elemental analyses were in agreement with those expected for the structural formula:

Te 5 1,1,1-Trichloro-6-hydroxy-3-methyl-2,1,4-benzoxatellurazinium, inner salt
$R = CH_3$, $R^1 = OH$, $R^2 = H$, $X = Cl$
$C_8H_8Cl_3NO_2Te$ mw = 383.95

3-Hydroxyacetanilide (60 g=0.4 mole) and $TeCl_4$ (107.6 g=0.4 mole) were combined in acetonitrile (80 ml) and the mixture immersed for 2 hours in an oil bath maintained at 120° C. To the hot melt was then added enough acetonitrile to make a paste. The mixture chilled overnight and filtered with suction to give 86.5 g, 56% of theory, colorless crystalline solid. For analysis this was recrystallized from hot acetonitrile, where 25 g required 150 ml of solvent and gave a recovery of 10 g colorless needles, m.p. 247°-248° C. The elemental analyses were in agreement with that expected for the structural formula:

EXAMPLES 1 THROUGH 5

The five oxatellurazinium compounds prepared above as well as a control compound C 6 were evaluated in a sulfur and gold sensitized silver bromoiodide emulsion. C 6 was chosen as a control since it is a well-known effective antifoggant and there are no sulfur or selenium analogues of the oxatellurazinium compounds. The compounds were added at the levels indicated and coated on cellulose acetate support to achieve a silver coverage of 4.9 g/m$^2$ and a gelatin coverage of 11.1 g/m$^2$. To show the characteristics of the emulsion without an intentionally added fog reducing agent, a coating was also prepared to which none of the above compounds was added. Samples of the coatings were exposed to a tungsten light source in an Eastman 1B sensitometer through a wedge spectrograph. The coatings were developed for five minutes in a hydroquinone-Elon® (p-N-methylaminophenol hemisulfate) developer, fixed, washed, and dried. Samples of each of the coatings were incubated for two weeks at 49° C. under 50 percent relative humidity before being exposed and processed as described above. A characteristic (density vs log exposure) curve was plotted for each coating. The sensitivity and fog (Dmin) data were determined from these curves. The results are reported in the Table I. The structure of compound C 6 is set forth below:

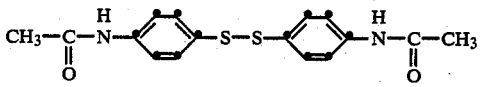

C 6

TABLE I

| Compound | Level (mmole/mole Ag) | Fresh Sensitivity | Fresh Fog | After Incubation Sensitivity | After Incubation Fog |
|---|---|---|---|---|---|
| Te 5 | 0.015 | 102 | 0.12 | 55 | 0.44 |
| | 0.15 | 95 | 0.09 | 73 | 0.19 |
| Te 1 | 0.015 | 91 | 0.10 | 63 | 0.44 |
| | 0.15 | 95 | 0.10 | 91 | 0.19 |
| Te 4 | 0.015 | 95 | 0.09 | 53 | 0.45 |
| | 0.15 | 95 | 0.09 | 95 | 0.19 |
| Te 2 | 0.015 | 95 | 0.09 | 53 | 0.46 |
| | 0.15 | 91 | 0.09 | 94 | 0.23 |
| Te 3 | 0.015 | 97 | 0.10 | 55 | 0.46 |
| | 0.15 | 95 | 0.09 | 83 | 0.28 |
| C 6 | 0.015 | 67 | 0.07 | 82 | 0.33 |
| | 0.15 | 68 | 0.07 | 80 | 0.26 |
| None | — | 100 | 0.10 | 25 | 0.79 |

EXAMPLES 6 THROUGH 10

Examples 1 through 5 were repeated, except that control compound C 6 was replaced with 4-hydroxy-6-methyl-1,3,3a,7-tetraazaindene, sodium salt, Compound C 7. A summary of this data is presented in Table II.

TABLE II

| Compound | Level (mmole/mole Ag) | Fresh Sensitivity | Fresh Fog | After Incubation Sensitivity | After Incubation Fog |
|---|---|---|---|---|---|
| Te 5 | 0.15 | 112 | 0.16 | 94 | 0.23 |
| Te 1 | 0.15 | 110 | 0.15 | 85 | 0.30 |
| Te 4 | 0.15 | 107 | 0.15 | 87 | 0.29 |
| Te 2 | 0.15 | 100 | 0.15 | 91 | 0.35 |
| Te 3 | 0.15 | 105 | 0.14 | 85 | 0.29 |
| C 7 | 0.15 | 105 | 0.14 | 53 | 0.57 |
| | 1.50 | 105 | 0.14 | 95 | 0.29 |
| None | — | 100 | 0.18 | 19.5 | 1.03 |

This data illustrates that Compound C 7, a common antifoggant, is clearly not as active as the oxatellurazinium compounds, all of which were highly effective.

The invention has been described in detail with particular reference to preferred embodiments thereof, but it will be understood that variations and modifications can be effected within the spirit and scope of the invention.

What is claimed is:

1. A photographic element containing a radiation sensitive silver halide emulsion and an effective amount of a fog inhibiting agent characterized in that the fog inhibiting agent is an aromatic oxatellurazinium salt.

2. A photographic element according to claim 1 further characterized in that said silver halide emulsion contains surface latent image forming silver halide grains.

3. A photographic element according to claim 2 further characterized in that said silver halide grains are surface chemically sensitized.

4. A photographic element according to claim 2 further characterized in that said silver halide grains are spectrally sensitized.

5. A photographic element according to claim 1 further characterized in that said aromatic oxatellurazinium salt is comprised of a 1,2,5-oxatellurazinium ring fused with a carbocyclic aromatic ring.

6. A photographic element according to claim 5 further characterized in that said oxatellurazinium salt is a 2,1,4-benzoxatellurazinium inner salt.

7. A photographic element according to claim 1 further characterized in that said oxatellurazinium salt is incorporated in said silver halide emulsion.

8. A photographic element according to claim 7 further characterized in that said oxatellurazinium salt is present in a concentration of from 0.005 to 5.0 millimole per silver mole.

9. A photographic element according to claim 8 further characterized in that said oxatellurazinium salt is present in a concentration of from 0.5 to 0.01 millimole per silver mole.

10. A photographic element according to claim 1 further characterized in that said oxatellurazinium salt satisfies the formula

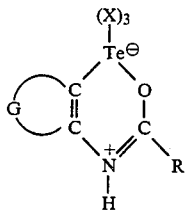

wherein:

G represents the atoms completing an aromatic nucleus,

R represents an aliphatic or aromatic group comprised of a hydrocarbon moiety optionally linked through a divalent oxy, thio, or carbonyl linkage, an amino group, an amido group, a ureido group, a formamidine disulfide group, or a —C(O)M group, wherein M is chosen to complete an acid, ester, thioester, or salt, and X represents halogen or pseudohalogen.

11. A photographic element according to claim 10 further characterized in that G represents the atoms completing a fused benzo or naphtho nucleus.

12. A photographic element according to claim 11 further characterized in said halogen is chosen from bromine and chlorine.

13. A photographic element according to claim 12 further characterized in that R is an alkyl group.

14. A photographic element according to claim 13 in which said oxatellurazinium salt is chosen from the group consisting of 1,1,1-trichloro-6-methoxy-3-methyl-2,1,4-benzoxatellurazinium, inner salt, 1,1,1-trichloro-3,6-di-methyl-2,1,4-benzoxatellurazinium, inner salt, 1,1,1-trichloro-3,6,7-trimethyl-2,1,4-benzoxatellurazinium, inner salt, 1,1,1-trichloro-6-methoxy-3-methylthio-2,1,4-benzoxatellurazinium, inner salt, and 1,1,1-trichloro-6-hydroxy-3-methyl-2,1,4-benzoxatellurazinium, inner salt.

15. A process of producing a photographic image comprising developing a photographic element containing at least one imagewise exposed silver halide emulsion layer in the presence of an effective amount of a fog inhibiting agent characterized in that the fog inhibiting agent is an aromatic oxatellurazinium salt.

16. A process of producing a photographic image according to claim 15 further characterized in that said oxatellurazinium salt is introduced into said photographic element during processing.

17. A process of producing a photographic image according to claim 16 further characterized in that said oxtellurazinium salt is initially present in a processing solution in a concentration of from 0.05 to 0.5 millimole per liter.

18. A process of producing a photographic image according to claim 15 further characterized in that said oxatellurazinium salt is initially present in a hydrophilic colloid layer of said photographic element.

19. A process of producing a photographic image according to claim 18 further characterized in that said oxatellurazinium salt is initially present in a radiation sensitive silver halide emulsion layer.

20. A process of producing a photographic image comprising developing an imagewise exposed photographic element according to any one of claims 1 through 14.

* * * * *